US005105834A

United States Patent [19]

Saintsing et al.

[11] Patent Number: 5,105,834

[45] Date of Patent: Apr. 21, 1992

[54] CIGARETTE AND CIGARETTE FILTER ELEMENT THEREFOR

[75] Inventors: Barry L. Saintsing; Jerry W. Redding, both of Lexington; Milly M. L. Wong; Thomas A. Perfetti, both of Winston-Salem, all of N.C.

[73] Assignee: R.J. Reynolds Tobacco Company, Winston-Salem, N.C.

[21] Appl. No.: 606,287

[22] Filed: Nov. 6, 1990

Related U.S. Application Data

[63] Continuation-in-part of Ser. No. 452,175, Dec. 18, 1989, Pat. No. 5,060,669.

[51] Int. Cl.[5] ..... A24D 3/12; A24D 3/14

[52] U.S. Cl. ..... 131/334; 131/335; 131/341; 131/342; 131/343; 131/344

[58] Field of Search ..... 131/335, 341, 342, 343, 131/344, 334

[56] References Cited

U.S. PATENT DOCUMENTS

| | | | |
|---|---|---|---|
| 2,001,709 | 5/1935 | Davidson . | |
| 2,202,839 | 6/1940 | Davidson . | |
| 2,948,282 | 8/1960 | White . | |
| 3,144,024 | 8/1964 | Eichwald et al. | 131/335 |
| 3,219,041 | 11/1965 | Bromberg . | |
| 3,313,305 | 4/1967 | Noznick et al. . | |
| 3,319,630 | 5/1967 | Orrmins . | |
| 3,353,543 | 11/1967 | Sproull et al. . | |
| 3,368,566 | 2/1968 | Avedikian | 131/341 |
| 3,516,417 | 6/1970 | Moses . | |
| 3,584,630 | 6/1971 | Inskeep . | |
| 3,589,371 | 6/1971 | Laporte . | |
| 3,603,319 | 9/1971 | Badgett et al. . | |
| 3,635,226 | 1/1972 | Horsewell et al. . | |
| 3,768,489 | 10/1973 | Kiefer et al. . | |
| 3,849,241 | 11/1974 | Butin et al. . | |
| 4,022,222 | 5/1977 | Berger | 131/344 |
| 4,059,121 | 11/1977 | Brackmann et al. | 131/341 |
| 4,173,504 | 11/1979 | Tomioka et al. . | |
| 4,188,960 | 2/1980 | Morie et al. . | |
| 4,273,600 | 6/1981 | Luke . | |
| 4,318,417 | 3/1982 | Hiroshi et al. . | |
| 4,466,451 | 8/1984 | Bonnet et al. . | |
| 4,492,240 | 1/1985 | Hayes et al. . | |
| 4,546,040 | 10/1985 | Knotek et al. . | |
| 4,677,995 | 7/1987 | Kallianos et al. . | |
| 4,700,723 | 10/1987 | Yoshikawa et al. | 131/334 |
| 4,752,348 | 6/1988 | Bryant et al. | 131/343 |
| 4,763,674 | 8/1988 | Lelah . | |
| 4,793,365 | 12/1988 | Sensabaugh, Jr. et al. . | |
| 4,800,903 | 1/1989 | Ray et al. . | |
| 4,807,809 | 2/1989 | Pryor et al. . | |
| 4,811,745 | 3/1989 | Cohen et al. . | |
| 4,836,224 | 6/1989 | Lawson et al. . | |
| 4,858,629 | 8/1989 | Cundari . | |
| 4,889,143 | 12/1989 | Pryor et al. . | |
| 4,964,426 | 10/1990 | Lee et al. . | |
| 4,971,078 | 11/1990 | Deutsch et al. . | |
| 5,012,829 | 5/1991 | Thesing et al. | 131/344 |

FOREIGN PATENT DOCUMENTS

| | | |
|---|---|---|
| 0250806 | 1/1988 | European Pat. Off. . |
| 0304759 | 3/1989 | European Pat. Off. . |
| 0330709 | 9/1989 | European Pat. Off. . |
| 346648 | 12/1989 | European Pat. Off. . |
| 363288 | 4/1990 | European Pat. Off. . |
| 383018 | 8/1990 | European Pat. Off. . |
| 2170391 | 1/1985 | United Kingdom . |
| 2190275 | 11/1987 | United Kingdom . |

OTHER PUBLICATIONS

Publication No. FTR-80, Published by Eastman Chemical Company.

*Primary Examiner*—V. Millin
*Assistant Examiner*—Lynne Reichard

[57] ABSTRACT

A cigarette comprises a blend of tobacco materials and a filter element provided from a non-woven thermoplastic material. The non-woven material comprises polyester or polypropylene fibers. The non-woven material is in intimate contact with a water soluble tobacco extract and a further material for altering the character of mainstream smoke which passes through the filter element. The tobacco extract can be a spray dried extract which has been subjected to heat treatment. The further material can be an acid (e.g., levulinic acid), a base (e.g., sodium hydroxide) or a salt (e.g., diammonium hydrogen orthophosphate).

70 Claims, 1 Drawing Sheet

CIGARETTE AND CIGARETTE FILTER ELEMENT THEREFOR

CROSS-REFERENCE TO RELATED APPLICATION

This is a continuation-in-part of U.S. patent application Ser. No. 452,175, U.S. Pat. No. 5,060,699 filed Dec. 18, 1989 the disclosure of which is incorporated herein by reference.

BACKGROUND OF THE INVENTION

The present invention relates to smoking articles such as cigarettes, and in particular to filter elements for cigarettes.

Popular smoking articles, such as cigarettes, have a substantially cylindrical rod shaped structure and include a charge of smokable material such as shredded tobacco (e.g., cut filler) surrounded by a paper wrapper, thereby forming a so-called "tobacco rod." It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Cigarettes are employed by the smoker by lighting one end thereof and burning the tobacco rod. The smoker then receives mainstream smoke into his/her mouth by drawing on the opposite end (i.e., the filter end) of the cigarette. Drawn smoke passes through the filter element before reaching the mouth of the smoker.

It would be desirable to provide a cigarette which provides flavorful mainstream smoke.

SUMMARY OF THE INVENTION

The present invention relates to smoking articles, such as cigarettes. Smoking articles of the present invention comprise a filter element including a segment (e.g., a rod shaped segment) having a filter material comprising thermoplastic fibers. The filter material comprising the thermoplastic fibers is a non-woven filter material and is in intimate contact with a material capable of altering (e.g., enhancing) the flavor characteristics of mainstream smoke which passes through the segment during use of the smoking article. Such a segment is referred to as a "flavor-containing filter segment." The flavor-containing filter segment includes a tobacco extract in intimate contact with the filter material. If desired, the tobacco extract can be a spray dried tobacco extract which has been subjected to heat treatment. Normally, prior to smoking the cigarette, the flavor-containing filter segment includes up to about 60 percent tobacco extract, based on the dry weight of the filter material and tobacco extract in intimate contact therewith. The flavor-containing filter segment includes, in addition to the tobacco extract, a further material for altering the flavor characteristics of the mainstream smoke which passes through the segment during use of the smoking article. Such further material is in intimate contact with the filter material and the tobacco extract, and can be an acidic material, a basic material or a salt. Normally, prior to smoking the cigarette, the flavor-containing filter segment includes about 0.01 to about 10 percent of such further material, based on the dry weight of the tobacco extract of the flavor-containing filter segment.

The filter element may include only a flavor-containing filter segment, or the filter element may include such a segment combined with at least one other filter segment. Normally, the flavor-containing segment includes fibers of polyester, polypropylene or polyethylene; and the other filter segment with which the flavor-containing filter segment is combined includes non-woven cellulose acetate tow or non-woven cellulose acetate web.

Smoking articles of the present invention (i.e., which have flavor-containing filter segments incorporated therein) can have various forms. Preferred smoking articles are rod shaped. For example, the smoking article can have the form of a cigarette having a smokable material (e.g., tobacco cut filler) wrapped in a circumscribing paper wrapping material. Exemplary cigarettes are described in U.S. Pat. Nos. 4,561,454 to Guess; 4,924,883 to Perfetti et al; 4,924,888 to Perfetti et al; 4,941,485 to Perfetti et al; 4,941,486 to Dube et al and 4,942,888 to Montoya et al; as well as U.S. patent application Ser. Nos. 528,302, filed May 24, 1990; 567,520, filed Aug. 15, 1990 and 601,551, filed Oct. 23, 1990. Other suitable smoking articles are described in U.S. Pat. Nos. 4,771,795 to White et al; 4,714,082 to Banerjee et al; 4,756,318 to Clearman et al; 4,793,365 to Sensabaugh et al; 4,827,950 to Banerjee et al; 4,938,236 to Banerjee et al and 4,955,399 to Potter et al; European Patent Application Nos. 212,234; 277,519; 280,990 and 305,788; and U.S. patent application Ser. Nos. 486,025, filed Feb. 27, 1990; 574,327, filed Aug. 29, 1990 and 576,751, filed Aug. 29, 1990.

DETAILED DESCRIPTION OF THE PREFERRED EMBODIMENTS

Figure 1:
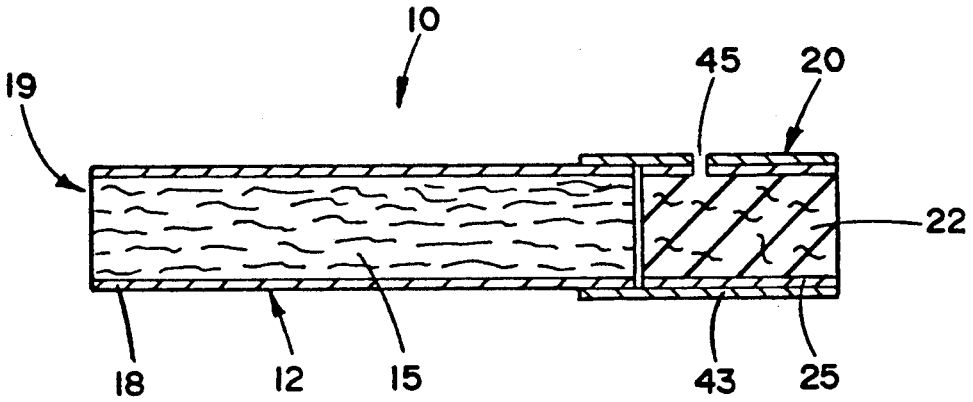
FIGS. 1 and 2 are longitudinal, sectional views of rod-shaped smoking articles representative of the present invention.
Figure 2:
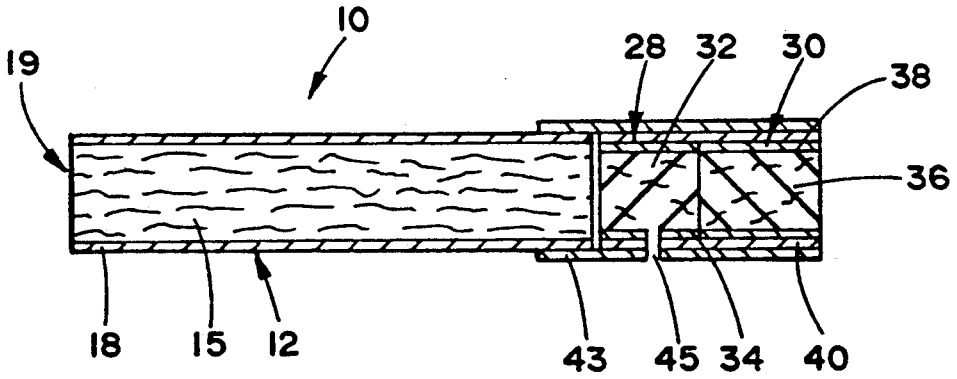

Representative embodiments of smoking articles of the present invention are shown in FIGS. 1 and 2. Cigarette 10 includes a generally cylindrical rod 12 of a charge or roll of smokable filler material 15 to be burned contained in circumscribing wrapping material 18. The rod 12 is conveniently referred to as a "smokable rod" or a "tobacco rod." The ends of the tobacco rod are open to expose the smokable filler material. The smokable rod is used by lighting one end 19 thereof, and aerosol (e.g., smoke) is provided as a result of the combustion of the burning smokable material. As such, the smokable rod burns from the lit end thereof towards the opposite end thereof.

Typically, the tobacco rod 12 has a length which ranges from about 50 mm to about 85 mm, and a circumference of about 16 mm to about 28 mm. The tobacco rods and the resulting cigarettes can be manufactured in any known configuration using known cigarette making techniques and equipment. The tobacco rod can have two layers of circumscribing paper wrapping material, if desired.

Referring to FIG. 1, cigarette 10 normally includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod 12. The ends of the filter element are open to permit the passage of air and smoke therethrough. The filter element 20 includes filter material 22 which is overwrapped along the longitudinally extending surface thereof with circumscribing plug wrap material 25.

Typically, the filter element 20 has a length which ranges from about 20 mm to about 35 mm and a circumference of about 16 mm to about 28 mm. The plug wrap 25 typically is a conventional paper plug wrap, and can be either air permeable or essentially air impermeable.

Filter element 20 includes a thermoplastic filter material 22 which is in intimate contact with a material capable of altering the flavor characteristics of the mainstream smoke of the cigarette. As such, there is provided a flavor-containing filter material. The filter material is in intimate contact with a tobacco extract and a further material for altering the flavor characteristics of mainstream smoke which passes through the filter element.

Referring to FIG. 2, cigarette 10 includes a filter element 20 having a first cylindrical filter segment 28 and second cylindrical filter segment 30. Filter element 20 has a generally cylindrical shape, and the diameter thereof is essentially equal to the diameter of the tobacco rod 12. The first and second segments are longitudinally disposed relative to one another. The first filter segment 28 is positioned adjacent one end of the tobacco rod 12, and the second filter segment is positioned adjacent one end of the first filter segment. The first filter segment 28 includes a first filter material 32 which is overwrapped along the longitudinally extending surface thereof with a circumscribing plug wrap material 34. The second filter segment 30 includes a second filter material 36 which is similarly overwrapped with a plug wrap material 38. The filter segments 28, 30 are axially aligned in an end-to-end relationship, preferably abutting one another; and are maintained in place by circumscribing outer plug wrap material 40. The inner surface of the outer plug wrap 40 is fixedly secured to the outer surfaces of the plug wraps of respective filter segments 28 and 30. The filter segments can be provided in the desired alignment using plug tube combination machinery which is familiar to the skilled artisan.

Normally, the first filter segment 28 includes filter material 32 which is a flavor-containing filter material. That is, the first filter segment includes a filter material which includes thermoplastic fibers in intimate contact with materials which are capable of altering the flavor characteristics of mainstream smoke. The second filter segment 30 normally includes filter material 36 which has the form of plasticized cellulose acetate tow, non-woven cellulose acetate web, polypropylene tow, gathered non-woven polypropylene web, or the like. The second segment can be a nonwrapped cellulose acetate filter element, if desired. Most preferably, the filter materials of each of the first and second segments are different from one another. Flavors and other smoke modifying agents can be incorporated into the second filter segment, if desired. Various second segments can be provided from filter rods which are manufactured using known techniques and machinery.

Referring again to both of FIGS. 1 and 2, filter element 20 is attached to the tobacco rod 12 using tipping material 43 which circumscribes both the entire length of the filter element and an adjacent region of the tobacco rod. The inner surface of the tipping material 43 is fixedly secured to the outer surface of the filter element 20 and the outer surface of the wrapping material 18 of the tobacco rod, using a suitable adhesive. A preferred ventilated or air diluted cigarette is provided with an air dilution means such as a series of perforations 45 each of which extend through the tipping material and plug wrap. Preferably, the series of perforations is positioned such that air drawn through those perforations passes through at least a portion of the length of the first filter segment 28 to the mouth of the smoker.

One type of filter material useful for providing a flavor-containing filter material comprises polyester fibers. See, for example, U.S. patent application Ser. No. 518,597, now abandoned filed May 3, 1990, which is incorporated herein by reference. Polyesters are synthetic polymers which commonly are made by esterifying polybasic organic acids with polyhydric alcohols. For example, dimethyl terephthalate and ethylene glycol can be reacted to form polyethylene terephthalate. Polyester fibers can make up the total composition of the filter material. Alternatively, that filter material can be a mixture or blend of polyester fibers with wood pulp, polyolefin fibers (e.g., polyethylene or polypropylene fibers), cellulose acetate fibers, polyvinylacetate fibers, cotton fibers, or the like. Typically, the filter material comprises at least about 25 percent polyester fibers, preferably at least about 40 percent polyester fibers, based on the weight of that filter material. The filter material can have the form of a non-woven web of fibers or a tow. Alternatively, the filter material can have a sheet-like form, particularly when the material is formed from a mixture of polyester fibers and wood pulp. Filter material in web or sheet-like form can be gathered, folded or otherwise formed into a suitable (e.g., cylindrical) configuration using techniques which will be apparent to the skilled artisan. See, for example, U.S. Pat. No. 4,807,809 to Pryor et al and U.S. patent application Ser. No. 585,444, filed Sep. 20, 1990, which are incorporated herein by reference.

Another type of filter material useful for providing a flavor-containing filter material includes polyester fibers available as 4SW Fiber from Eastman Chemical Company. A preferred filter material is a non-woven web comprising 4SW Fiber, and is available as 4TD Non-woven Web from Eastman Chemical Co. Preferably, such a filter material is provided as a sheet-like web in contact with about 0.1 to about 3 weight percent of a lubricant, such as mineral oil or polyethylene glycol monolaurate (e.g., PEG-600 monolaurate). See also, U.S. patent application Ser. No. 033,651, now abandoned filed Apr. 4, 1989 and U.S patent application Ser. No. 592,723, now abandoned filed Oct. 4, 1990, which are incorporated herein by reference.

Another type of filter material useful for providing a flavor-containing filter material includes polypropylene fibers. A highly preferred sheet-like web of non-woven polypropylene fiber is available as PP200SD from Kimberly-Clark Corp. Such a web can be manufactured using a melt blowing process as is described in U.S. Pat. No. 3,849,241 to Buntin et al. See, for example, European Patent Application 330,709, Pat. No. 330,709 and U.S. patent application Ser. No. 414,835, Pat. No. 5,076,295 filed Sep. 29, 1989, which are incorporated herein by reference.

Another type of filter material useful for providing a flavor-containing filter material includes polyethylene fibers. Polyethylene fibers can make up the total composition of the filter material of the flavor-containing filter material. Alternatively, that filter material can be a mixture or blend of polyethylene fibers with wood pulp, polypropylene fibers, cellulose acetate fibers, polyvinylacetate fibers, polyester fibers, cotton fibers, or the like. Typically, the filter material comprises at least about 25 percent polyethylene fibers, preferably at least about 40 percent polyethylene fibers, and often greater than 50 percent polyethylene fibers, based on the weight of that filter material. The filter material can have the form of a non-woven web of fibers or a tow. Alternatively, the filter material can have a sheet-like form, particularly when the material is formed from a mixture of polyethylene fibers and wood pulp. Filter material in web or sheet-like form can be gathered, folded or otherwise formed into a suitable (e.g., cylindrical) configuration using techniques which will be apparent to the skilled artisan. See, for example, U.S. patent application Ser. No. 541,007, filed Jun. 20, 1990, which is incorporated herein by reference.

As the composition of the filter material, the form of the filter material and the configuration of the filter material can vary, the filtration efficiency for particulate matter of each ultimate filter segment can vary from relatively low to relatively high.

Preferred tobacco extracts which are intimately contacted with the filter materials to form the flavor-containing filter materials are tobacco extracts which are provided by extracting a tobacco material with a solvent having an aqueous character (i.e., a solvent consisting primarily of water, preferably greater than 90 weight percent water, and often essentially pure water). The specific composition of the tobacco extract can vary, depending upon factors such as the type of tobacco material which is extracted, the extraction solvent and the type of extraction conditions. Preferred tobacco extracts have nicotine contents of less than about 50 percent, usually of less than about 25 percent, and frequently less than about 15 percent, based on the dry weight of the extract. Such preferred tobacco extracts have relatively high contents of many of the flavorful components of tobacco. Methods for preparing and processing tobacco extracts are set forth in European Patent Application Nos. 326,370 and 338,831, which are incorporated herein by reference. Other tobacco extracts are those extracts which are subjected to heat treatment, such as those tobacco extracts set forth in U.S. patent application Ser. Nos. 346,042, Pat. No. 4,986, 286 filed May 2, 1989; 452,175, Pat. No. 5,060,669 filed Dec. 18 1989 Pat. No. 5,074,319 filed Apr. 19, 1990; and 536,250, filed Jun. 11, 1990, which are incorporated herein by reference.

Typical flavor-containing filter materials are manufactured by providing a tobacco extract within a liquid, applying the liquid and extract to a web or sheet of the filter material using a rotogravure or size press technique, and removing the liquid the web or sheet. If desired, the tobacco extract can be provided within a liquid carrier, and then sprayed onto the filter material. The tobacco extract can be a spray dried extract, a freeze dried extract or a tobacco essence which is in turn dissolved or otherwise dispersed in water or other liquid carrier in order to be applied to the filter material. Typically, the tobacco extract which is in intimate contact with the filter material has a moisture content of about 5 to about 6 weight percent, although the moisture content of a particular tobacco extract can vary.

Typical filter materials in intimate contact with the tobacco extract include up to about 60 percent, preferably about 5 to about 55 percent, more preferably about 10 to about 45 percent, and most preferably about 20 to about 40 percent tobacco extract, based on the total dry weight of the filter material and tobacco extract, prior to the time that the cigarette into which the resulting filter element is incorporated is smoked.

The further materials for altering the flavor characteristics of the mainstream smoke can vary. Such further materials can be acidic materials, basic materials or salts. By "acidic materials" is meant materials or substances which behave as Bronstead acids, and have functionalities which can provide protons. By "basic materials" is meant materials or substances which behave as Lewis bases, and have functionalities which can provide electron pairs. By "salt" is meant the reaction product of an acidic material and a basic material.

The further mainstream smoke altering materials which are intimately contacted with the tobacco extracts and filter materials can include acids, such as the organic and inorganic acids. Typical organic acids comprise at least one carboxylic acid functionality. Exemplary organic acids include levulinic, pyruvic, malic, malonic, maleic, tartaric, citric, oxalic, lactic, fumaric, adipic, acetic, propionic, phenylacetic, butyric, isovaleric, caproic, caprylic and capric acids. Exemplary organic acids also can include the amino acids, such as serine, theonine, phenylalanine, glutamine, proline, asparagine, aspartic acid and glutamic acid. Exemplary inorganic acids include boric, hydrochloric, sulfuric and phosphoric acids. Certain acids, such as the amino acids, contain both acidic and basic functionalities. The further mainstream smoke altering materials can include bases, such as inorganic and organic bases. Exemplary inorganic bases include hydroxides of sodium, potassium, magnesium and calcium. Exemplary organic bases include urea and tobacco extracts having high nicotine contents. For purposes of the present invention, tobacco extracts having high nicotine contents have nicotine contents above about 80 weight percent, preferably above about 90 weight percent, based on the dry weight of the extract. The further mainstream smoke altering materials can include inorganic salts of organic acids, salts of inorganic acids and organic salts of organic acids. Exemplary salts include the sodium, potassium, calcium and magnesium salts of the previously mentioned organic acids; the sodium, potassium, calcium and magnesium salts of phosphoric acid, boric acid, and carbonic acid; ammonium salts of phosphoric acid, carbonic acid and the previously mentioned organic acids; and the nicotine salts of the previously mentioned organic and inorganic acids. The nicotine salts of the organic acids typically have molar ratios of organic acid to nicotine of 1:1, 2:1 and 3:1. Exemplary nicotine salts of organic acids are set forth in U.S. Pat. No. 4,830,028 to Lawson et al, which is incorporated herein by reference.

The amount of further mainstream smoke altering material which is intimately contacted with the tobacco extract and filter material can vary; but typically ranges from about 0.01 to about 10 percent, preferably about 0.05 to about 6 percent, and more preferably about 0.1 to about 3 percent, based on the dry weight of the tobacco extract present in the flavor-containing filter material. The further mainstream smoke altering material can be contacted with the tobacco extract and filter material by injection techniques, size press techniques, rotogravure techniques, or the like. The further mainstream smoke altering material can be contacted with the filter material before, while, or after, the tobacco extract is contacted with the filter material. The further mainstream smoke altering material can be contacted with the filter material along with the tobacco extract. The further mainstream smoke altering material can be subjected to heat treatment along with the tobacco extract. The further mainstream smoke altering material can be contacted with the filter material of an adjacent filter segment (e.g., using injection techniques), and allowed to migrate to the flavor-containing filter segment.

Flavor-containing filter materials also can include a minor amount of a lubricating substance. Exemplary lubricating substances include polyhydric alcohols (e.g., glycerin, propylene glycol, or the like), fatty acids, mineral oils, vegetable oils and polyethylene glycol esters of fatty acids. The lubricating substance provides flexibility to the web or tow, and provides a web or tow which can be shaped without the application of heat.

Typical filter materials in intimate contact with the tobacco extract, further mainstream smoke altering material and optional lubricating substance include up to about 60 percent, preferably about 5 to about 55 percent, more preferably about 10 to about 45 percent tobacco extract, and up to about 10 percent, preferably up to about 5 percent lubricating substance, based on the total dry weight of the filter material, tobacco extract, further material and optional lubricating substance, prior to the time that the cigarette into which the resulting filter segment is incorporated is smoked. The optional lubricating substance is intimately contacted with the filter material and is contacted with that filter material in much the same manner as is the further mainstream smoke altering material.

Other mainstream smoke altering materials which include materials for enhancing the flavor characteristics of the mainstream smoke also can be employed. Such materials include cocoa, licorice, sugars, syrups, menthol and spearmint, as well as Amadori compounds and amino sugars (e.g., glucosamine and asparaginofructose).

The smokable materials useful herein can vary. Examples of highly preferred smokable materials are the tobacco materials which include flue-cured, Oriental, Maryland and Burley tobaccos, as well as the rare and specialty tobaccos. Generally, the tobacco material has been aged. The tobacco material can be in the form of tobacco laminae, processed tobacco stems, reconstituted tobacco material, volume expanded tobacco filler, or blends thereof. The type of reconstituted tobacco material can vary (i.e., the reconstituted tobacco material can be manufactured using a variety of reconstitution processes). Blends of the aforementioned materials and tobacco types can be employed. Other smokable materials, such as those smokable materials described in U.S. patent application Ser. Nos. 414,833, filed Sep. 29, 1989 and 416,332, filed Sep. 29, 1989, also can be employed. The smokable materials generally are employed in the form of cut filler as is common in conventional cigarette manufacture. For example, the smokable filler material can be employed in the form of pieces, shreds or strands cut into widths ranging from about 1/5 inch to about 1/60 inch, preferably from about 1/20 inch to about 1/40 inch. Generally, such pieces have lengths which range from about 0.25 inch to about 3 inches.

The filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. See, for example, U.S. Pat. No. 4,830,028 to Lawson et al.

The wrapping material which circumscribes the charge of smokable filler can vary. Examples of suitable wrapping materials are cigarette paper wrappers available as Ref. No. 719, 754, 756, 854 and 856 from Kimberly-Clark Corp. As suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and cigarette paper wrappers available as TOD 01788, TOD 03363, TOD 03732, TOD 03957, TOD 03949, TOD 03950, TOD 03953, TOD 03954, TOD 04706, TOD 04742 and TOD 04708 from Ecusta Corp. Certain paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123-114 from Kimberly-Clark Corp. Another suitable paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are available as TOD 03732 and TOD 04742 from Ecusta Corp. Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette.

Preferably, the air dilution means is positioned along the length of the cigarette at a point along the filter element which is at a maximum distance from the extreme mouthend thereof. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of this invention, the amount of air dilution can vary. Generally, the amount of air dilution for an air diluted cigarette is greater than about 10 percent, typically greater than about 20 percent, and often greater than about 30 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

The following example is provided in order to further illustrate various embodiments of the invention but should not be construed as limiting the scope thereof. Unless otherwise noted, all parts and percentages are by weight.

EXAMPLE 1

Cigarettes substantially as shown in FIG. 2 are prepared as follows:

The cigarettes have a length of 84 mm and a circumference of 24.8 mm, and include a smokable rod having a length of 57 mm and a filter element having a length of 27 mm. Each smokable rod comprises a blend of smokable material circumscribed by a single layer of paper wrapper. The weight of the smokable material within each smokable rod is about 0.665 g. Each filter element includes two segments. The first segment is a flavor-containing filter segment. The first filter segment is positioned adjacent the smokable rod. The second segment includes cellulose acetate tow (3.3 denier per filament, 35,000 total denier) plasticized with triacetin and circumscribed by non-porous paper plug wrap. The second filter segment has a length of 15 mm, and is positioned adjacent the first filter segment. Each filter element is attached to each tobacco rod using non-porous tipping paper. For each cigarette, the tipping paper circumscribes the filter element and a 4 mm length of the tobacco rod in the region adjacent the filter element. The cigarettes are not air diluted.

The filter material of the first filter segment is a continuous non-woven sheet-like web available as 4TD from Eastman Chemical Co. The web includes polyester fibers available as 4SW from Eastman Chemical Company. The web has a basis weight of about 1.25 oz/yd$^2$, and a width of about 7.75 inches. The web has less than about 1 percent mineral oil applied thereto. The web has a tobacco extract in intimate contact therewith. The first filter segment is provided by subdividing a rod provided by gathering the continuous web from a bobbin using the apparatus described in U.S. patent application Ser. No. 585,444, filed Sep. 20, 1990. The apparatus is similar to that rod making apparatus described in Example 1 of U.S. Pat. No. 4,870,809 to Pryor et al, and includes a constriction member (i.e., tongue) fashioned so that a continuous supply of water is applied to the web-contacting surface of the tongue. Each filter segment so provided includes a circumscribing non-porous paper plug wrap, and weighs about 0.118 g.

The tobacco extract is intimately contacted with the filter material as follows. A spray dried aqueous Burley tobacco extract and a spray dried flue-cured tobacco extract are contacted with tap water to provide about 20 parts flue-cured tobacco extract and about 20 parts Burley tobacco extract dissolved in about 60 parts water. The resulting mixture of tobacco extract and water is applied to the filter material using a rotogravure type process. In particular, the extract and water are applied to the web of filter material using a Schiavi L13 Laminator, dried at about 200° F. to about 325° F., and then used to provide the first filter segment. The first filter segment includes about 60 parts filter material and about 40 parts tobacco extract. The filter material having tobacco extract in intimate contact therewith has a moisture content of about 2 to about 5 percent.

Each of the previously described spray dried extracts are provided by extracting tobacco laminae in cut filler form with water in a stainless steel tank at a concentration of about 1 to about 1.5 pounds tobacco per gallon of water. The extraction is conducted at ambient temperature over a period of about 1 to about 3 hours, while the slurry of tobacco in water is mechanically agitated. The slurry then is centrifuged to remove suspended solids. The aqueous tobacco extract is concentrated in a thin film evaporator to a concentration of about 30 percent dissolved tobacco solids. The concentrated aqueous extract then is spray dried by continuously pumping the aqueous extract to an Anhydro Size No. 1 Spray Dryer. The dried powder is collected at the outlet of the spray dryer. The inlet temperature of the spray dryer is about 215° C., and the outlet temperature is about 82° C. The spray dried powdered extract has a moisture content of about 6 to about 8 percent, and a nicotine content of about 5 to about 10 percent.

The first filter segment has levulinic acid incorporated therein, so that the levulinic acid is in intimate contact with the filter material and the tobacco extract. In particular, the acid is dissolved in water so as to provide an acid solution of about 0.1 percent concentration, and about 1.5 microliters of the acid solution is injected into the first filter segment using a syringe. As such, the first filter segment includes about 12.7 ppm levulinic acid in intimate contact with the tobacco extract and filter material, based on the weight of the tobacco extract and filter material. The filter segment then is allowed to set for at least 24 hours.

The paper wrapper of the smokable rod comprises flax and calcium carbonate. The paper wrapper is available as Reference No. 854 from Kimberly-Clark Corp.

The smokable material is a blend of volume expanded flue-cured and Burley tobacco laminae, flue-cured tobacco laminae, Burley tobacco laminae, reconstituted tobacco and Oriental tobacco laminae. The smokable material is in the form of laminae cut into strands at 32 cuts per inch. The volume expanded tobacco is tobacco laminae which is cut into cut filler form and which has been expanded.

The blend of smokable materials is cased and top dressed with humectants and flavors, and is provided so as to have total moisture content of about 12 percent.

The cigarettes then are employed by burning the smokable rod such that the blend of smokable material within the paper wrapper burns to yield smoke. The resulting cigarette provides good tobacco flavor and is smoother tasting than a similar cigarette not having levulinic acid incorporated into the first filter segment. The cigarette yields a satisfying, rounded smoking character.

EXAMPLE 2

A cigarette is provided as described in Example 1, except that the first filter segment includes about 1.2 percent levulinic acid in intimate contact with the tobacco extract and filter material, based on the weight of the tobacco extract and filter material. In particular, about 11.6 microliters of an aqueous solution of acid having a concentration of about 1 percent is injected into the filter segment.

The cigarette is smoked as described in Example 1, and provides mainstream smoke which is very mild. The cigarette provides mainstream smoke having a satisfying, flavorful, smooth tobacco taste having slight woody and peppery notes.

EXAMPLE 3

A cigarette is provided as described in Example 1, except that the first filter segment includes about 2.4 percent levulinic acid in intimate contact with the tobacco extract and filter material, based on the weight of the tobacco extract and filter material. In particular, about 2.3 microliters of an aqueous solution of acid having a concentration of about 10 percent is injected into the filter segment.

The cigarette is smoked as described in Example 1, and exhibits organoleptic characteristics similar to those provided by the cigarette described in Example 2.

EXAMPLE 4

A cigarette is provided as described in Example 1, except that the first filter segment includes about 12.7 ppm sodium hydroxide (rather than the levulinic acid) in intimate contact with the tobacco extract and filter material, based on the weight of the tobacco extract and filter material. In particular, about 1.5 microliters of an aqueous solution of sodium hydroxide having a concentration of about 0.1 percent is injected into the filter segment.

The cigarette is smoked as described in Example 1, and provides mainstream smoke which is mild tasting. The cigarette provides satisfying tobacco taste and no discernable off-taste.

EXAMPLE 5

A cigarette is provided as described in Example 1, except that the first filter segment includes about 2.4 ppm sodium hydroxide (rather than the levulinic acid) in intimate contact with the tobacco extract and filter material, based on the weight of the tobacco extract and filter material. In particular, about 2.8 microliters of an aqueous solution of sodium hydroxide having a concentration of about 10 percent is injected into the filter segment.

The cigarette is smoked as described in Example 1, and exhibits organoleptic characteristics similar to those provided by the cigarette described in Example 4.

EXAMPLE 6

A cigarette is provided as described in Example 1, except that the first filter segment includes about 1.2 percent of a further tobacco extract having a nicotine content of about 95 percent (rather than levulinic acid) in intimate contact with the tobacco extract and filter material, based on the weight of the tobacco extract and filter material. In particular, about 14 microliters of an aqueous solution of the further tobacco extract having a concentration of about 1 percent is injected into the filter segment.

The cigarette is smoked as described in Example 1, and provides flavorful, rounded, full-bodied, satisfying mainstream smoke.

EXAMPLE 7

A cigarette is provided as described in Example 1, except that the first filter segment includes about 2.4 percent of a further tobacco extract having a nicotine content of about 95 percent (rather than levulinic acid) in intimate contact with the tobacco extract and filter material, based on the weight of the tobacco extract and filter material In particular, about 2.8 microliters of an aqueous solution of the further tobacco extract having a concentration of about 10 percent is injected into the filter segment.

The cigarette is smoked as described in Example 1 and exhibits organoleptic characteristics similar to those provided by the cigarette described in Example 6.

EXAMPLE 8

A cigarette is provided as described in Example 1, except that the first filter segment includes about 1.2 percent of a salt of nicotine and levulinic acid (rather than levulinic acid) in intimate contact with the tobacco extract and filter material, based on the weight of the tobacco extract and filter material. In particular, about 14 microliters of an aqueous solution of that salt having a concentration of about 1 percent is injected into the filter segment.

The salt of nicotine and levulinic acid is provided using the following procedure. Into a 1000 ml round bottom flask is charged about 500 g of 1-nicotine provided from Kodak Laboratory Chemicals, Eastman Kodak Co. (Catalogue No. 52, p. 366, Chemical No. 1124973). To the 1-nicotine is charged about 10 g of sodium hydroxide pellets. The flask is fitted with a heating mantle and equipped with a magnetic stirring bar. The nicotine solution is stirred employing a magnetic stirring unit. The nicotine is vacuum distilled using a Todd Column packed with glass helixes, and the fraction distilled between 97° C. and 98° C. at 10 mm Hg pressure is collected at a reflux ratio of about 10:1. The collected distillate is water clear. The nicotine so purified using the vacuum distillation technique is employed in the preparation of the 1-nicotine/levulinic acid salt.

Into a 1000 ml round bottom flask equipped with a magnetic stirring bar and heating mantle is charged 232 g (2 moles) of levulinic acid. The levulinic acid is stirred employing a conventional magnetic stirring unit. The levulinic acid is obtained from Aldrich Chemical Co., Catalogue No. 1984-85, p. 672, Compound No. L-200-9, and is employed without further purification. The levulinic acid is heated to about 50° C. in order to provide a liquid form thereof, and the liquified component is subjected to stirring. To the liquified levulinic acid is titrated 324 g (2 moles) of the purified 1-nicotine over about a 20 minute time period. It is preferred to introduce the nicotine to the organic acid in order to provide an environment of excess acid to nicotine and thus promote the formation of salt. A clear, viscous yellow colored material weighing about 556 g results. The product is sealed in a glass ampoule under nitrogen.

The product is 1-nicotine levulinate (as determined using infrared spectrometry), and has a nicotine to levulinic acid ratio of 1:1 (as determined using carbon nuclear magnetic resonance spectroscopy and by a destructive distillation in a 10 percent sodium hydroxide aqueous solution, subsequent extraction using isopropanol, and gas chromatographic analysis for nicotine). The salt is believed to have a structure substantially as described in FIG. 3, of Perfetti, *Beitrage Zur Tabak. Int.*, Vol. 12, p. 43 (1983).

The cigarette is smoked as described in Example 1, and provides mainstream smoke having a satisfying, mild, smooth tobacco taste.

EXAMPLE 9

A cigarette is provided as described in Example 1, except that the first filter segment includes about 2.4 percent of a salt of nicotine and levulinic acid (rather than levulinic acid) in intimate contact with the tobacco extract and filter material, based on the weight of the tobacco extract and filter material. The salt is described in Example 8. In particular, about 2.8 microliters of an aqueous solution of that salt having a concentration of about 10 percent is injected into the filter segment.

The cigarette is smoked as described in Example 1, and exhibits organoleptic characteristics similar to those provided by the cigarette described in Example 8.

EXAMPLE 10

Cigarettes are provided in the manner described in Example 1, except that the first filter segment is provided by gathering or pleating a non-woven web of polypropylene fibers using the rod forming apparatus described in Example 1. The web has a width of 11.75 inches, a basis weight of about 0.7 oz/yd$^2$, and is available as PP200SD from Kimberly-Clark Corp. The web so described has applied thereto the Burley and flue-cured tobacco extracts as described in Example 1. In particular, a spray dried aqueous Burley and flue-cured tobacco extracts are dissolved in water, applied to the non-woven polypropylene web using a rotogravure process, and the resulting wet web is dried to provide tobacco extract in intimate contact with the polypropylene web. The resulting web comprises about 60 percent polypropylene and about 40 percent tobacco extract. The web having tobacco extract in intimate contact therewith has a moisture content of about 2 to about 5 percent. Each filter segment so provided includes a circumscribing non-porous paper plug wrap, and weighs about 0.108 g.

The first filter segment has levulinic acid incorporated therein, so that the levulinic acid is in intimate contact with the filter material and the tobacco extract. In particular, the acid is dissolved in water so as to provide an acid solution of about 0.1 percent concentration, and about 1 microliter of the acid solution is injected into the first filter segment using a syringe. As such, the first filter segment includes about 9.3 ppm levulinic acid in intimate contact with the tobacco extract and filter material, based on the weight of the tobacco extract and filter material. The filter segment then is allowed to set for at least 24 hours.

The cigarette is smoked as described in Example 1, and provides pleasant tasting mainstream smoke which is mild and smooth in character.

EXAMPLE 11

A cigarette is provided as described in Example 10, except that the first filter segment includes about 1.1 percent levulinic acid in intimate contact with the tobacco extract and filter material, based on the weight of the tobacco extract and filter material. In particular, about 11.6 microliters of an aqueous solution of acid having a concentration of about 1 percent is injected into the filter segment.

The cigarette is smoked as described in Example 1, and exhibits organoleptic characteristics similar to those provided by the cigarette described in Example 10.

EXAMPLE 12

A cigarette is provided as described in Example 10, except that the first filter segment includes about 2.1 percent levulinic acid in intimate contact with the tobacco extract and filter material, based on the weight of the tobacco extract and filter material. In particular, about 2.3 microliters of an aqueous solution of acid having a concentration of about 10 percent is injected into the filter segment.

The cigarette is smoked as described in Example 1, and exhibits organoleptic characteristics similar to those provided by the cigarette described in Example 10.

EXAMPLE 13

A cigarette is provided as described in Example 10, except that the first filter segment includes about 1.1 percent diammonium hydrogen orthophosphate (rather than levulinic acid) in intimate contact with the tobacco extract and filter material, based on the weight of the tobacco extract and filter material. In particular, about 11.6 microliters of an aqueous solution of that salt having a concentration of about 1 percent is injected into the filter segment.

The cigarette is smoked as described in Example 1, and provides mainstream smoke having a mild, satisfying, smooth, rounded tobacco taste.

EXAMPLE 14

A cigarette is provided as described in Example 10, except that the first filter segment includes about 2.1 percent diammonium hydrogen orthophosphate (rather than levulinic acid) in intimate contact with the tobacco extract and filter material, based on the weight of the tobacco extract and filter material. In particular, about 2.3 microliters of an aqueous solution of that salt having a concentration of about 10 percent is injected into the filter segment.

The cigarette is smoked as described in Example 1, and exhibits organoleptic characteristics similar to those provided by the cigarette described in Example 13.

EXAMPLE 15

A cigarette is provided as described in Example 10, except that the first filter segment includes about 9.3 ppm phenylacetic acid (rather than levulinic acid) in intimate contact with the tobacco extract and filter material, based on the weight of the tobacco extract and filter material. In particular, about 1 microliter of an aqueous solution of that acid having a concentration of about 0.1 percent is injected into the filter segment.

The cigarette is smoked as described in Example 1, and provides flavorful, satisfying mainstream smoke having a slight honey-swelt taste.

EXAMPLE 16

A cigarette is provided as described in Example 10, except that the first filter segment includes about 1.1 percent phenylacetic acid (rather than levulinic acid) in intimate contact with the tobacco extract and filter material, based on the weight of the tobacco extract and filter material. In particular, about 11.6 microliters of an aqueous solution of that acid having a concentration of about 1 percent is injected into the filter segment.

The cigarette is smoked as described in Example 1, and exhibits the organoleptic characteristics similar to those provided by the cigarette described in Example 15.

EXAMPLE 17

A cigarette is provided as described in Example 10, except that the first filter segment includes about 1.1 percent sodium carbonate (rather than levulinic acid) in intimate contact with the tobacco extract and filter material, based on the weight of the tobacco extract and filter material. In particular, about 11.6 microliters of an aqueous solution of sodium carbonate having a concentration of about 1 percent is injected into the filter segment.

The cigarette is smoked as described in Example 1, and provides mainstream smoke which is mild and smooth tasting as compared to a similar cigarette not having sodium carbonate not incorporated into the first filter segment.

EXAMPLE 18

A cigarette is provided as described in Example 10, except that the first filter segment includes about 2.1 percent sodium carbonate (rather than levulinic acid) in intimate contact with the tobacco extract and filter material, based on the weight of the tobacco extract and filter material. In particular, about 2.3 microliters of an aqueous solution of sodium carbonate having a concentration of about 10 percent is injected into the filter segment.

The cigarette is smoked as described in Example 1, and exhibits organoleptic characteristics similar to those provided by the cigarette described in Example 17.

EXAMPLE 19

A filter segment having a length of 10 mm and having the form of a flavor-containing filter segment is provided as set forth in Example 1. The filter segment so provided is used to replace the tobacco paper filter in the cigarette described in *Chemical and Biological Studies on New Cigarette Prototypes That Heat Instead of Burn Tobacco,* R. J. Reynolds Tobacco Co., (1988).

EXAMPLE 20

A filter segment having a length of 10 mm and having the form of a flavor-containing filter segment is provided as set forth in Example 5. The filter segment so provided is used to replace the tobacco paper filter in the cigarette described in *Chemical and Biological Studies on New Cigarette Prototypes That Heat Instead of Burn Tobacco,* R. J. Reynolds Tobacco Co., (1988).

EXAMPLE 21

A filter segment having a length of 10 mm and having the form of a flavor-containing filter segment is provided as set forth in Example 10. The filter segment so provided is used to replace the tobacco paper filter in the cigarette described in *Chemical and Biological Studies on New Cigarette Prototypes That Heat Instead of Burn Tobacco.* R. J. Reynolds Tobacco Co., (1988).

EXAMPLE 22

A filter segment having a length of 10 mm and having the form of a flavor-containing filter segment is provided as set forth in Example 18. The filter segment so provided is used to replace the tobacco paper filter in the cigarette described in *Chemical and Biological Studies on New Cigarette Prototypes That Heat Instead of Burn Tobacco,* R. J. Reynolds Tobacco Co., (1988).

EXAMPLE 23

A cigarette is provided as described in Example 5, except that the second filter segment which includes the cellulose acetate tow is injected with 2.3 microliters of a 10 percent aqueous solution of malic acid.

EXAMPLE 24

A cigarette is provided as described in Example 1, except that the first filter segment includes about 2 percent of salt of nicotine and levulinic acid (rather than levulinic acid) in intimate contact with the tobacco extract and filter material, based on the weight of the tobacco extract and filter material. In particular, about 2.8 microliters of an aqueous solution of that salt having a concentration of about 10 percent is injected into the filter segment.

The salt of nicotine and levulinic acid is provided using reagents, techniques and equipment essentially as described in Example 8, except that 162 g (1 mole) of levulinic acid is contacted with 232 g (2 moles) of the 1-nicotine. The salt is believed to have a structure substantially as described in FIG. 5 of Perfetti, *Beitrage Zur Tabak. Int.,* Vol. 12, p. 43 (1983).

EXAMPLE 25

A cigarette is provided generally as described in Example 10, except that a heat treated tobacco extract and an amino acid is intimately contacted with the filter material of the second filter segment rather than the tobacco extracts and levulinic acid as described in Example 10.

A heat treated tobacco extract and organic acid mixture is provided as follows: An "American blend" of tobacco filler in dust form is extracted with water, and a spray dried extract is provided in much the same manner as described in Example 1. Then, into a pressure vessel available as Parr Reactor Model No. 4522 equipped with a temperature control unit Parr No. 4842-PID from the Parr Instrument Co. is charged about 8 parts glutamic acid, about 30 parts of the spray dried extract and about 62 parts water. The pressure vessel is equipped with a mechanical stirrer. The moist extract then is subjected to heat treatment by exposure to a maximum temperature of about 180° C. for about 30 minutes. Then, the heat treated tobacco extract and residual amino acid are removed from the pressure vessel.

The resulting heat treated tobacco extract and residual amino acid are dissolved in water and applied to a non-woven polypropylene web of the type described in Example 10 in the manner described in Example 10. The resulting first filter segment includes about 25 parts heat treated tobacco extract and amino acid, and about 75 parts filter material, on a dry weight basis.

EXAMPLE 26

A cigarette is provided as described in Example 25, except that the amino acid is alanine (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 30 parts heat treated tobacco extract and amino acid, and about 70 parts filter material, on a dry weight basis.

EXAMPLE 27

A cigarette is provided as described in Example 25, except that the amino acid is aspartic acid (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 26.5 parts heat treated tobacco extract and amino acid, and about 73.5 parts filter material, on a dry weight basis.

EXAMPLE 28

A cigarette is provided as described in Example 25, except that the amino acid is asparagine (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 26 parts heat treated tobacco extract and amino acid, and about 74 parts filter material, on a dry weight basis.

EXAMPLE 29

A cigarette is provided as described in Example 25, except that the amino acid is glutamine (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 28.5 parts heat treated tobacco extract and amino acid, and about 71.5 parts filter material, on a dry weight basis.

EXAMPLE 30

A cigarette is provided as described in Example 25, except that the amino acid is phenylalanine (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 29 parts heat treated tobacco extract and amino acid, and about 71 parts filter material, on a dry weight basis.

EXAMPLE 31

A cigarette is provided as described in Example 25, except that the amino acid is proline (rather than glutamic acid) and is contacted with the spray dried extract prior to the heat treatment.

The resulting heat treated tobacco extract and residual amino acid are contacted with the filter material described in Example 10 in the manner described in Example 10. The resulting first filter segment includes about 29 parts heat treated tobacco extract and amino acid, and about 71 parts filter material, on a dry weight basis.

EXAMPLE 32

A cigarette is provided as described in Example 25, except that potassium carbonate (rather than glutamic acid) is contacted with the spray dried extract prior to heat treatment. In particular, about 10 parts potassium carbonate, about 30 parts of the spray dried extract and about 60 parts water are subjected to heat treatment.

The resulting heat treated tobacco extract and residual potassium carbonate are contacted with the filter material described in Example 10 in the manner described in Example 10. The resulting first filter segment includes about 25 parts heat treated tobacco extract and potassium carbonate, and about 75 parts filter material, on a dry weight basis.

EXAMPLE 33

A filter rod of about 120 mm length and about 24.55 mm circumference is provided. The filter material within each rod is a gathered web of non-woven polypropylene sheet available as PP-100 from Kimberly-Clark Corp. The filter material within each rod weighs about 0.964 g. The gathered filter material is circumscribed by a nonporous paper plug wrap available as Ref. No. 646 from Ecusta Corp. The filter rod is manufactured using the apparatus generally described is Example 1 of U.S. Pat. No. 4,807,809 to Pryor et al.

A heat treated mixture of spray dried tobacco extract and glutamine is provided using the equipment described in Example 25, and as described in Example 15 of U.S. patent application Ser. No. 452,175, filed Dec. 18, 1989. Then, the heat treatment mixture is applied to the filter rod. In particular, the tobacco composition is passed through a small funnel placed at one end of the filter rod, and is allowed to drain through the filter rod. The filter rod then is air dried to constant weight. The filter rod experiences a weight increase of about 58 mg.

The filter rod is divided into filter segments of 21 mm length, and each segment is combined with a tobacco rod of 64 mm length to provide a filter cigarette. The cigarette is smoked and yields mainstream smoke high in tobacco flavor.

What is claimed is:

1. A cigarette having a charge of smokable material wrapped in a circumscribing paper wrapping material to form a smokable rod; the cigarette comprising a filter element positioned adjacent one end of the smokable rod; the filter element including a non-woven thermoplastic filter material contacted with and in intimate contact with a tobacco extract and about 0.01 to about 10 percent acidic material, based on the dry weight of the tobacco extract.

2. The cigarette of claim 1 wherein the filter material in intimate contact with the tobacco extract and acidic material comprises about 5 to about 55 percent tobacco extract, based on the total weight of the filter material and tobacco extract.

3. The cigarette of claim 1 wherein the tobacco extract is a water soluble tobacco extract.

4. The cigarette of claim 1 wherein the acidic material is an organic acid.

5. The cigarette of claim 1, 2 or 3 wherein the non-woven filter material comprises polyethylene fibers.

6. The cigarette of claim 1, 2 or 3 wherein the non-woven filter material comprises polyester fibers.

7. The cigarette of claim 6 wherein the non-woven filter material consists essentially of polyester fibers.

8. The cigarette of claim 6 wherein the non-woven filter material consists essentially of polyester fibers and lubricant.

9. The cigarette of claim 1, 2 or 3 wherein the non-woven filter material comprises polypropylene fibers.

10. The cigarette of claim 9 wherein the non-woven filter material consists essentially of polypropylene fibers.

11. The cigarette of claim 1, 2 or 3 wherein the filter element includes first and second longitudinally disposed filter segments; the first segment including a non-woven filter material contacted with and in intimate contact with tobacco extract and acidic material being disposed adjacent the smokable rod, and the second segment including a non-woven filter material being disposed adjacent the first segment.

12. The cigarette of claim 11 wherein the non-woven filter material of the second segment includes cellulose acetate.

13. The cigarette of claim 11 wherein the filter material of the first segment comprises polyester fibers.

14. The cigarette of claim 11 wherein the filter material of the first segment comprises polypropylene fibers.

15. The cigarette of claim 11 wherein the filter material in intimate contact with the tobacco extract and acidic material comprises about 0.1 to about 3 percent acidic material, based on the dry weight of the tobacco extract.

16. The cigarette of claim 11, wherein the nicotine content of the tobacco extract is less than about 25 percent, based on the dry weight of the tobacco extract.

17. The cigarette of claim 1, 2 or 3 wherein the acidic material is an inorganic acid.

18. The cigarette of claim 1 wherein the filter material in intimate contact with the tobacco extract and acidic material comprises about 0.1 to about 3 percent acidic material, based on the dry weight of the tobacco extract.

19. The cigarette of claim 1 or 2, wherein the nicotine content of the tobacco extract is less than about 25 percent, based on the dry weight of the tobacco extract.

20. The cigarette having a charge of smokable material wrapped in a circumscribing paper wrapping material to form a smokable rod; the cigarette comprising a filter element positioned adjacent one end of the smokable rod; the filter element including a non-woven thermoplastic filter material contacted with and in intimate contact with a tobacco extract and about 0.01 to about 10 percent basic material, based on the dry weight of the tobacco extract.

21. The cigarette of claim 20 wherein the filter material in intimate contact with the tobacco extract and basic material comprises about 5 to about 55 percent tobacco extract, based on the total dry weight of the filter material and tobacco extract.

22. The cigarette of claim 20 wherein the tobacco extract is a water soluble tobacco extract.

23. The cigarette of claim 20, 21 or 22 wherein the non-woven filter material comprises polyethylene fibers.

24. The cigarette of claim 20, 21 or 22 wherein the non-woven filter material comprises polyester fibers.

25. The cigarette of claim 24 wherein the non-woven filter material consists essentially of polyester fibers.

26. The cigarette of claim 24 wherein the non-woven filter material consists essentially of polyester fibers and lubricant.

27. The cigarette of claim 20, 21 or 22 wherein the non-woven filter material comprises polypropylene fibers.

28. The cigarette of claim 27 wherein the non-woven filter material consists essentially of polypropylene fibers.

29. The cigarette of claim 20, 21 or 22 wherein the filter element includes first and second longitudinally disposed filter segments; the first segment including a non-woven filter material contacted with and in intimate contact with tobacco extract and basic material being disposed adjacent the smokable rod, the second segment including a non-woven filter material being disposed adjacent the first segment.

30. The cigarette of claim 29 wherein the non-woven filter material of the second segment includes cellulose acetate.

31. The cigarette of claim 29 wherein the filter material of the first segment comprises polyester fibers.

32. The cigarette of claim 29 wherein the filter material of the first segment comprises polypropylene fibers.

33. The cigarette of claim 29 herein the filter material in intimate contact with the tobacco extract and basic material comprises about 0.1 to about 3 percent basic material, based on the dry weight of the tobacco extract.

34. The cigarette of claim 29, wherein the nicotine content of the tobacco extract is less than about 25 percent, based on the dry weight of the tobacco extract.

35. The cigarette of claim 20 wherein the basic material includes an acidic functionality and a basic functionality.

36. The cigarette of claim 20, 21 or 22 wherein the basic material is an inorganic base.

37. The cigarette of claim 20 wherein the filter material in intimate contact with the tobacco extract and basic material comprises about 0.1 to about 3 percent basic material, based on the dry weight of the tobacco extract.

38. The cigarette of claim 20 or 21, wherein the nicotine content of the tobacco extract is less than about 25 percent, based on the dry weight of the tobacco extract.

39. A cigarette having a charge of smokable material wrapped in a circumscribing paper wrapping material to form a smokable rod; the cigarette comprising a filter element positioned adjacent one end of the smokable rod; the filter element including a non-woven thermoplastic filter material contacted with and in intimate contact with a tobacco extract and about 0.01 to about 10 percent salt, based on the dry weight of the tobacco extract.

40. The cigarette of claim 39 wherein the filter material in intimate contact with the tobacco extract and salt comprises about 5 to about 55 percent tobacco extract, based on the total dry weight of the filter material and tobacco extract.

41. The cigarette of claim 39 wherein the tobacco extract is a water soluble tobacco extract.

42. The cigarette of claim 39, 40 or 41 wherein the non-woven filter material comprises polyethylene fibers.

43. The cigarette of claim 39, 40 or 41 wherein the non-woven filter material comprises polyester fibers.

44. The cigarette of claim 43 wherein the non-woven filter material consists essentially of polyester fibers.

45. The cigarette of claim 43 wherein the non-woven filter material consists essentially of polyester fibers and lubricant.

46. The cigarette of claim 39, 40 or 41 wherein the non-woven filter material comprises polypropylene fibers.

47. The cigarette of claim 46 wherein the non-woven filter material consists essentially of polypropylene fibers.

48. The cigarette of claim 39, 40 or 41 wherein the filter element includes first and second longitudinally disposed filter segments, the first segment including a non-woven filter material contacted with and in intimate contact with tobacco extract and salt being disposed adjacent the smokable rod, the second segment including a non-woven filter material being disposed adjacent the first segment.

49. The cigarette of claim 48 wherein the non-woven filter material of the second segment includes cellulose acetate.

50. The cigarette of claim 48 wherein the filter material of the first segment comprises polyester fibers.

51. The cigarette of claim 48 wherein the filter material of the first segment comprises polypropylene fibers.

52. The cigarette of claim 48 wherein the filter material in intimate contact with the tobacco extract and salt comprises about 0.1 to about 3 percent salt, based on the dry weight of the tobacco extract.

53. The cigarette of claim 48, wherein the nicotine content of the tobacco extract is less than about 25 percent, based on the dry weight of the tobacco extract.

54. The cigarette of claim 39 wherein the filter material in intimate contact with the tobacco extract and salt comprises about 0.1 to about 3 percent salt, based on the dry weight of the tobacco extract.

55. The cigarette of claim 39 or 40, wherein the nicotine content of the tobacco extract is less than about 25 percent, based on the dry weight of the tobacco extract.

56. A smoking article comprising a filter element which includes a non-woven thermoplastic filter material contacted with and in intimate contact with a tobacco extract and about 0.01 to about 10 percent basic material, based on the dry weight of the tobacco extract.

57. A smoking article comprising a filter element which includes a non-woven thermoplastic filter material contacted with and in intimate contact with a tobacco extract and about 0.01 to about 10 percent acidic material, based on the dry weight of the tobacco extract.

58. A smoking article comprising a filter element which includes a non-woven thermoplastic filter material contacted with and in intimate contact with a tobacco extract and about 0.01 to about 10 percent salt, based on the dry weight of the tobacco extract.

59. The smoking article of claim 56, 57 or 58 wherein the non-woven material in intimate contact with the tobacco extract comprises about 5 to about 55 percent tobacco extract, based on the total dry weight of the material and extract.

60. The smoking article of claim 56, 57 or 58 wherein the tobacco extract has a moisture content of about 5 to about 6 weight percent.

61. The smoking article of claim 56, 57 or 58 wherein the filter material comprises polyester fibers.

62. The smoking article of claim 56, 57 or 58 wherein the filter material comprises polypropylene fibers.

63. The smoking article of claim 56 wherein the basic material is an inorganic base.

64. The cigarette of claim 56 wherein the filter material in intimate contact with the tobacco extract and basic material comprises about 0.1 to about 3 percent basic material, based on the dry weight of the tobacco extract.

65. The cigarette of claim 57 wherein the filter material in intimate contact with the tobacco extract and acidic material comprises about 0.1 to about 3 percent acidic material, based on the dry weight of the tobacco extract.

66. The cigarette of claim 58 wherein the filter material in intimate contact with the tobacco extract and salt comprises about 0.1 to about 3 percent salt, based on the dry weight of the tobacco extract.

67. The cigarette of claim 59, wherein the nicotine content of the tobacco extract is less than about 25 percent, based on the dry weight of the tobacco extract.

68. The smoking article of claim 61 wherein the non-woven filter material consists essentially of polyester fibers.

69. The smoking article of claim 61 wherein the non-woven filter material consists essentially of polyester fibers and lubricant.

70. The smoking article of claim 62 wherein the filter material consists essentially of polypropylene fibers.

* * * * *